US005482567A

United States Patent [19]

Barreto

[11] Patent Number: 5,482,567

[45] Date of Patent: Jan. 9, 1996

[54] MULTILAYER FORMING FABRIC

[75] Inventor: Ednaldo V. Barreto, João Pessoa, Brazil

[73] Assignee: Huyck Licensco, Inc., Wilmington, Del.

[21] Appl. No.: 349,922

[22] Filed: Dec. 6, 1994

[51] Int. Cl.[6] ..... D03D 23/00

[52] U.S. Cl. ..... 139/383 A; 428/116; 428/225; 428/257

[58] Field of Search ..... 428/116, 225, 428/257; 139/383 A; 162/DIG. 1

[56] References Cited

U.S. PATENT DOCUMENTS

| | | | |
|---|---|---|---|
| 3,885,603 | 5/1975 | Slaughter | 139/425 A |
| 4,267,226 | 5/1981 | Kohler et al. | 428/223 |
| 4,501,303 | 2/1985 | Osterberg | 139/383 A |
| 4,515,853 | 5/1985 | Borel | 428/257 |
| 4,554,953 | 11/1985 | Borel et al. | 139/383 A |
| 4,564,051 | 1/1986 | Odenthal | 139/425 A |
| 4,605,585 | 8/1986 | Johansson | 139/383 A |
| 4,611,639 | 9/1986 | Bugge | 139/383 A |
| 4,640,741 | 2/1987 | Tsumeo | 139/383 A |
| 4,729,412 | 3/1988 | Bagge | 139/383 A |
| 4,739,803 | 4/1988 | Borel | 139/383 A |
| 4,815,503 | 3/1989 | Borel | 139/383 A |
| 5,052,448 | 10/1991 | Givin | 139/383 A |
| 5,092,372 | 3/1992 | Fitzka et al. | 139/383 A |
| 5,238,536 | 8/1993 | Danby | 162/202 |
| 5,366,798 | 11/1994 | Ostermayer | 139/383 A |

FOREIGN PATENT DOCUMENTS 3329740 3/1985 Germany .

*Primary Examiner*—James J. Bell
*Attorney, Agent, or Firm*—Lorusso & Loud

[57] ABSTRACT

A triple layer fabric, useful in the forming section of a papermakers' machine, is provided. The fabric has a top fabric layer having at least one set of warp yarns interwoven with at least one set of weft yarns; a bottom fabric layer having at least two sets of weft yarns forming a top and bottom layer of the bottom fabric layer, and at least one set of warp yarns; and at least one binder yarn interweaving and joining the top fabric layer and the bottom fabric layer. The top fabric layer is preferably a plain weave fabric while the bottom fabric layer is preferably a semi-duplex weave. Also, in one preferred embodiment, the weft yarns in the bottom fabric layer are generally stacked, as are the warp and weft yarns of the top and bottom fabric layers. The binder yarns are preferably a binder warp yarns, but may be a binder wefts. In interweaving the top and bottom fabric layers, the binder yarns engage only the upper weft yarns or the warp yarns of the bottom fabric layer. Thus, the binder yarn is protected by the lower weft yarns of the bottom fabric layer from normal wear and abrasion thereby increasing fabric life.

18 Claims, 5 Drawing Sheets

MULTILAYER FORMING FABRIC

BACKGROUND OF THE INVENTION

This invention relates to papermakers' fabrics and especially to papermakers' fabrics for the forming section of a papermaking machine.

In the conventional papermaking process, a water slurry or suspension of cellulose fibers, known as the paper "stock", is fed onto the top of the upper run of a traveling endless forming belt. The forming belt provides a papermaking surface and operates as a filter to separate the cellulosic fibers from the aqueous medium to form a wet paper web. In forming the paper web, the forming belt serves as a filter element to separate the aqueous medium from the cellulosic fibers by providing for the drainage of the aqueous medium through its mesh openings, also known as drainage holes, by vacuum means or the like located on the drainage side of the fabric.

After leaving the forming medium, the somewhat self-supporting paper web is transferred to the press section of the machine and onto a press felt, where still more of its water content is removed by passing it through a series of pressure nips formed by cooperating press rolls, these press rolls serving to compact the web as well.

Subsequently, the paper web is transferred to a dryer section where it is passed about and held in heat transfer relation with a series of heated, generally cylindrical rolls to remove still further amounts of water therefrom.

Over the years, papermakers have sought improvements in the forming fabric, not only with respect to the operating life of the fabric, but also with respect to the quality of the paper sheet produced on it. Triple layer fabrics were introduced for this purpose. The triple layer fabric has two generally distinct surfaces. The top surface is one integral fabric structure designed specifically for papermaking to achieve the best possible sheet quality and machine efficiency. This top fabric is manufactured as an integral part of a woven structure with a completely separate bottom fabric designed specifically for mechanical stability and fabric life. The purpose of triple layer fabric development is to eliminate the compromises which exist with both single and double layer forming fabrics so that papermakers can produce the best possible paper sheet for top quality at reduced cost without sacrificing the wear characteristics of the papermakers' fabric.

References known in the art have described these so called triple layer fabrics with additional binder yarns in the warp direction and in the weft direction. Interconnection of the two fabric layers by a binder warp, however, has the drawback that during weaving the warp yarn is under tension so that it influences the structure on the paper side. Additionally, when a triple layer fabric is woven flat and made endless by means of a woven seam, the binder warp in the final screen extends in the longitudinal direction. Since the fabric is lengthened during thermosetting in the heating zone, the warp threads are again subject to high working tension. Owing to the fact that the weft threads of the lower layer are substantially thicker and stiffer, the tension of the binder warp affects nearly exclusively the finer threads of the upper layer. Thus, the binder warp pulls the fine weft threads of the upper layer deep into the fabric at the binding points, thereby causing distortions in the uniformity of the surface.

Accordingly, triple layer fabrics are in practice joined together by weft binder yarns. This solution is less than ideal, however, because the movement of the individual fabric layers relative to each other is unrestrained with the binder weft yarns. Delamination of these triple layer fabrics becomes a problem, reducing the fabric's life.

OBJECTS OF THE INVENTION

Accordingly, it is an object of the present invention to provide a novel triple layer fabric for use in a papermakers' machine.

It is another object of the present invention to provide a triple layer fabric in which the fabric layers are joined together by additional warp binder yarns.

Another object of the present invention is to provide such a fabric that has increased stability of the papermakers' fabric, resulting in a longer service life.

Still another object of the present invention is to provide a novel triple layer papermakers' fabric for a papermakers' machine that has an improved joining arrangement for the fabric layers.

A further object of the present invention is to provide such a papermakers' fabric with a superior papermaking surface, good wear life, abrasion resistance and good drainage.

These and other objects of the present invention will become apparent from a review of the following detailed description of the invention, taken together with the drawing, in which like reference numbers refer to like members throughout the different views.

BRIEF DESCRIPTION OF THE DRAWINGS

FIG. 7, including

SUMMARY OF THE INVENTION

Figure 1:
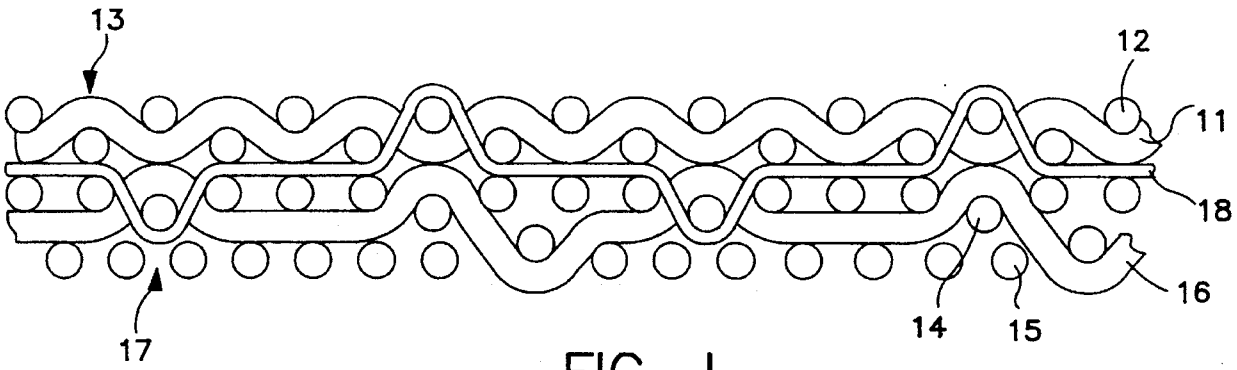
FIG. 1 is a sectional view in the weft direction of a fabric according to the present invention including additional warp binder yarns.

A triple layer fabric, useful in the forming section of a papermakers' machine, is provided. The triple layer fabric includes: a top fabric layer having at least one set of warp yarns interwoven with at least one set of weft yarns; a bottom fabric layer having at least two sets of weft yarns forming a top and bottom layer of the bottom fabric layer, and at least one set of warp yarns; and at least one binder yarn interweaving and joining the top fabric layer and the bottom fabric layer. The top fabric layer is preferably a plain weave fabric while the bottom fabric layer is preferably a semi-duplex weave. Also, in one preferred embodiment, the sets of weft yarns in the bottom fabric layer are generally stacked, as are the warp and weft yarns of the top and bottom fabric layers.

The binder yarn is preferably a binder warp yarn, but may be a binder weft. Additionally, the fabric may include both binder warp and weft yarns. In interweaving the top and bottom fabric layers, the binder yarns engage only the upper weft yarns or the warp yarns of the bottom fabric layer. Thus, the binder yarn is protected by the lower weft yarns of the bottom fabric layer from normal wear and abrasion thereby increasing fabric life. Fabric life is further increased in the case of a binder warp yarn since the friction during use between the fabric layers and the binder yarns is minimized.

The binder yarn may stitch the weft or warp yarns of the fabric layers in any repeating fashion. However, in the one preferred embodiment the binder warp yarn engages every eighth weft yarn of the top fabric layer and every eighth weft yarn in the top layer of the bottom fabric layer. In another embodiment, the binder weft yarn engages every fourth warp yarn of the top fabric layer and every fourth warp yarn in the bottom fabric layer.

DETAILED DESCRIPTION OF THE INVENTION

The fabric of the present invention is a triple layer fabric, incorporating a top fabric layer and a bottom fabric layer joined by an additional binder yarn in a particular manner.

For purposes of the present invention, reference will be made to "warp" and "weft" to define the path of travel of the yarns making up the fabric of the present invention. Generally, in a flat woven fabric, warp yarns travel in the warp direction and weft yarns travel in the weft direction. When the fabric is woven endless, however, the warp yarns travel in the weft direction and the weft yarns travel in the warp direction. One skilled in the relevant art will be aware of the distinction and can easily translate the concepts of the present invention to produce a fabric according to these concepts, noting the distinction above.

The yarns utilized in the fabric of the present invention will vary depending upon the desired properties of the final papermaking fabric, and of the papersheet to be formed on that fabric. For example, the yarns may be multifilament yarns, monofilament yarns, twisted multifilament or monofilament yarns, spun yarns or any combination of the above. It is within the skill of those practicing in the relevant art to select a yarn type, depending on the purpose of the desired fabric, to utilize the concepts of the present invention.

Yarn types selected for use in the fabric of the present invention may be those commonly used in papermaking fabrics. The yarns could be cotton, wool, polypropylene, polyester, aramid or nylon. Again, one skilled in the relevant art will select a yarn material according to the particular application of the final fabric.

The binder yarn, which joins the two fabric layers together, can be of the same diameter as the yarns in the top fabric layer and/or the bottom fabric layer. In a preferred embodiment, the binder yarns will be of smaller diameter than the yarns making up the fabric layers. A typical binder yarn will be a monofilament or multifilament thread of polypropylene or nylon.

The top fabric layer is designed to present an optimal surface for papermaking. The top fabric layer may be woven in any manner, but in a preferred embodiment, this fabric layer will be a plain weave. A plain weave is preferred because it presents a higher index of fiber support with greater drainage than most fabric weaves. With the support and drainage system provided, better fiber distribution of the forming paper web occurs. The pattern of a plain weave also presents optimal bicrimp conditions for papermaking.

The bottom fabric layer of the present invention, however, is a semi-duplex weave, having two weft yarn systems. The yarns in the top fabric layer can be of the same size and type as those in the bottom fabric layer, or they may be of a smaller diameter, depending upon the purpose of the final papermakers fabric. In the preferred embodiment of the present invention, the combination of a plain weave top fabric layer with a semi-duplex bottom fabric layer provides "inclined" drainage through the weft yarns' three systems. Additionally, a semi-duplex fabric is associated with good drainage due to the warp yarns' low density and the weft yarn systems' position.

In combination with these fabric layers, binder yarns of the present invention will preferably run in the warp direction thereby binding weft yarns from the top and bottom fabric layers. Binding in the warp direction has been found to have significant advantages because the direction of movement of the papermaking fabric and the stresses normally applied to forming fabrics in the paper machine are longitudinal. Accordingly, using warp yarns as binders reduces the stresses normally found with weft binder yarns.

In addition, since the bottom fabric layer is a semi-duplex weave in the preferred embodiment, the binder yarn in the warp direction will always engage a weft yarn from the upper set of weft yarns when it is binding the bottom fabric layer. In doing so, the binder yarn will form an interlayer in which the structural weft yarns are interlaced. This interlacing of a longitudinal binder yarn through the top layer and semi-duplex bottom fabric layer reduces the friction between the layers as the fabric works under stress in the longitudinal direction. In addition, since the binder yarns are subjected to the same longitudinal forces as the fabric layers, the friction between the layers and the binder yarns is significantly reduced thereby avoiding the rupture of binder yarns causing delamination.

Moreover, the semi-duplex bottom layer has two weft yarn systems and the top weft yarns of the semi-duplex bottom layer are interlaced with the weft yarns of the top fabric layer. This results in increased protection for the binder warp yarns because they are protected by the bottom weft yarns of the semi-duplex bottom layer from the fabric's common abrasion wear in the longitudinal direction. The weft yarns are better able to absorb the wear and abrasion caused by that contact, and therefore the papermakers fabric has a longer life.

Even though it is preferred that binder yarns are woven in the warp direction as discussed above, advantages can still be achieved when the binder yarn is woven in the weft direction. This is because binder yarns in either the warp or weft direction are protected from normal abrasion wear by the bottom weft yarns of the semi-duplex weave of the bottom fabric layer. Finally, it is also envisioned that binder yarns will run in both the warp and weft direction and will bind with both the warp and weft yarns of the top and bottom fabric layers.

In a papermakers' fabric of the present invention, the yarn systems are selected to facilitate and optimize the role each will play in the papermakers fabric. For example, the yarns that will face the paper to be formed will be finer, and of smaller diameter, than the remaining yarns. Similarly, the yarns that will face the machine elements of the papermakers machine will be coarser, and of larger diameter, than the remaining yarns. It is envisioned that one skilled in the art can select the sizes of yarns to optimize the concepts of the present invention.

Figure 2:
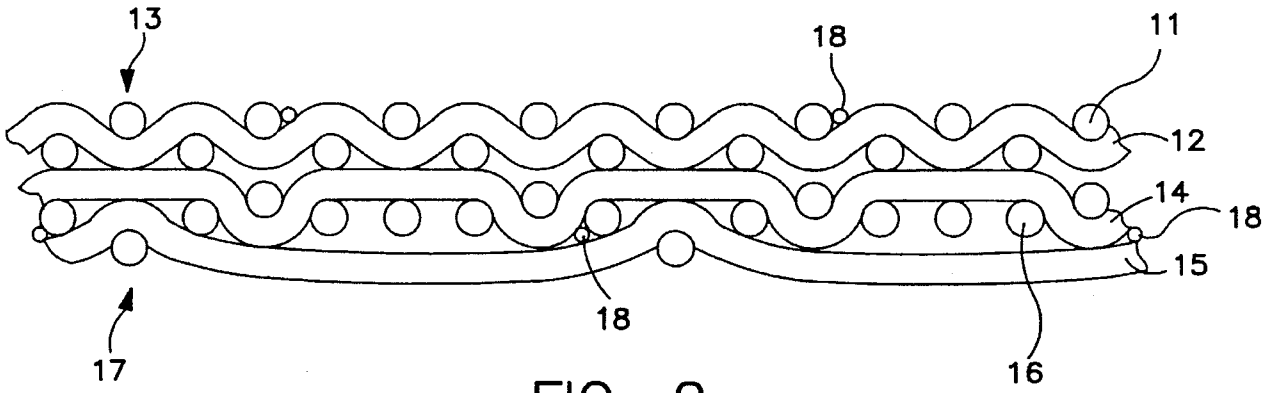
FIG. 2 is a sectional view in the warp direction of the fabric shown in FIG. 1.

FIGS. 1 and 2 show one embodiment of the fabric of the present invention. In those views, yarns 11 and 12 are the warp direction and weft direction yarns of the top fabric layer 13. Reference numbers 14 and 15 are weft direction yarns and 16 is the warp direction yarns of the bottom fabric layer 17. The top fabric layer 13 and bottom fabric layer 17 are joined by additional warp direction binder yarns 18. The binder yarns 18 may join with the weft direction yarns 12 of the top fabric layer 13 and the upper weft direction yarns 14 of the bottom fabric layer in any repeating pattern thereby forming an interlayer. In the preferred embodiment of FIGS. 1 and 2, however, the binder yarns 18 engage every eighth weft direction yarn 12 of the top fabric layer and every eighth upper weft direction yarn 14 of the bottom fabric layer 17.

It is evident from FIG. 2 that the configuration achieved by the weave of the present invention protects both the binder yarn 18 and most of the load bearing structural warp yarns 16 of the bottom fabric layer 17 from exposure to the machine elements on the papermaking machine and therefore from wear and abrasion. The binder yarns 18 and structural warp yarns 16 will not be exposed until the weft yarn 15 of the bottom fabric layer 17 wears completely through.

Figure 3:
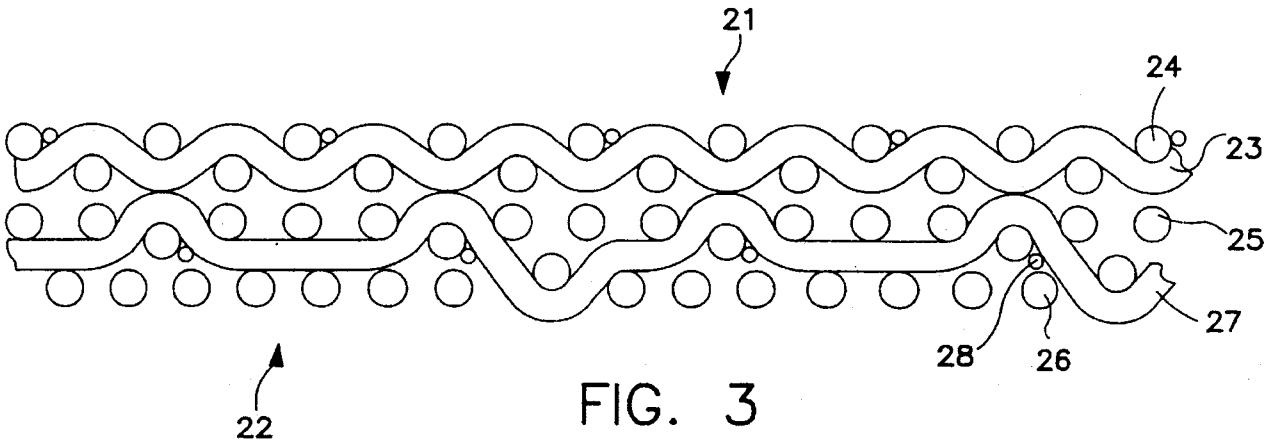
FIG. 3 is a sectional view in the weft direction of another embodiment of the present invention including additional weft binder yarns.
Figure 4:
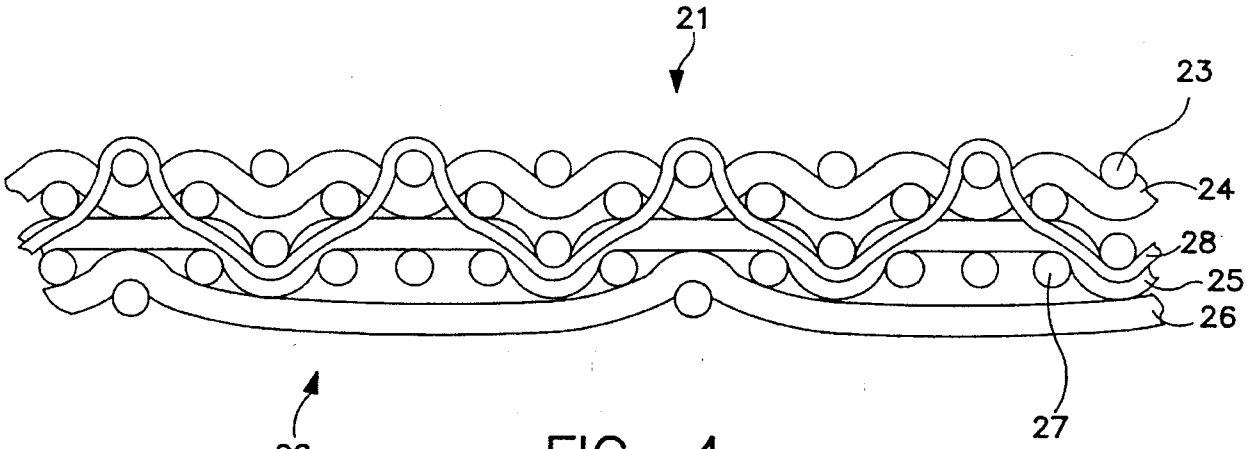
FIG. 4 is a sectional view in the warp direction of the fabric shown in FIG. 3.

FIGS. 3 and 4 illustrate another embodiment of the papermaking fabric of the present invention, one in which the additional binder yarn runs parallel to the weft yarns and therefore travels in the weft direction. This embodiment again features a plain weave top fabric layer 21, with a semi-duplex bottom fabric layer 22. Top fabric layer 21 has warp direction yarns 23 interwoven with weft direction yarns 24. In the bottom fabric layer 22, weft direction yarns 25 are generally stacked over weft direction yarns 26, and are interwoven with warp direction yarns 27. Additionally, binder yarns 28 run in the weft direction and engage the warp direction yarns 23 of the top fabric layer 21 and the warp direction yarns 27 of the bottom fabric layer 22. As in the embodiment of FIGS. 1 and 2, the binder yarns 28 may join with the warp direction yarns 23 of the top fabric layer 21 and the upper warp direction yarns 27 of the bottom fabric layer 22 in any repeating pattern thereby forming an interlayer. It is preferred, however, that the binder yarns 28 engage every fourth warp direction yarn 23 of the top fabric layer and every fourth upper warp direction yarn 27 of the bottom fabric layer.

Compared to the longitudinal binder yarn structure depicted in FIGS. 1 and 2, this structure may be manufactured on a loom with only two warp cylinders instead of three. In addition, the binder yarn 28 is protected by the bottom weft yarns 26 of the bottom semi-duplex fabric layer. Despite these advantages, however, the fabric of FIGS. 1–2 containing warp direction binder yarns is preferred since it has been found to be more resistant to delamination. This is primarily due to the fact that the forces on the fabric during operation are longitudinal, i.e. in the warp or warp direction. With binder yarns solely in the weft direction greater friction between the structural layers is observed resulting in expedited delamination.

Figure 5:
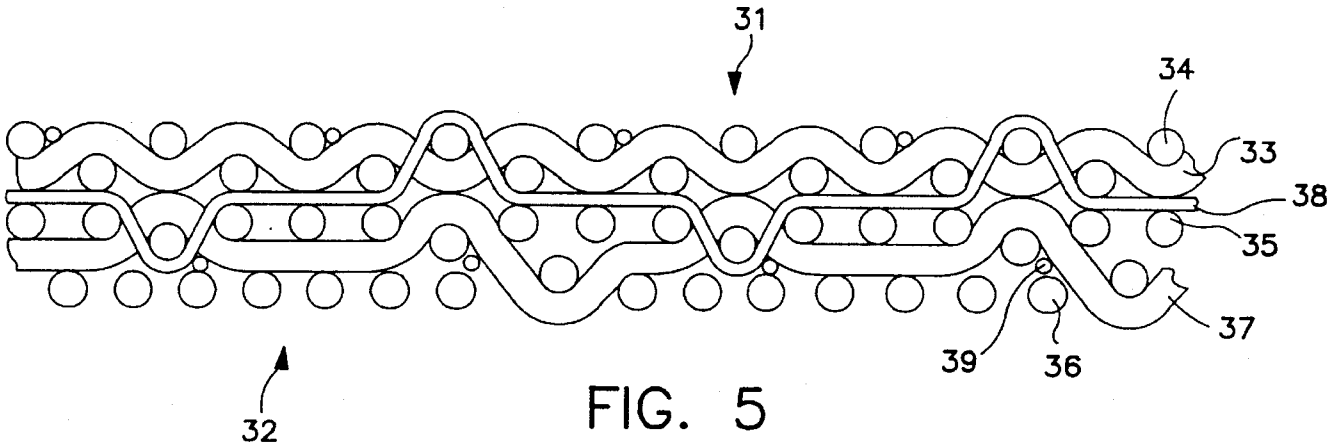
FIG. 5 is a sectional view in the weft direction of another embodiment of the present invention including both additional warp and weft binder yarns.
Figure 6:
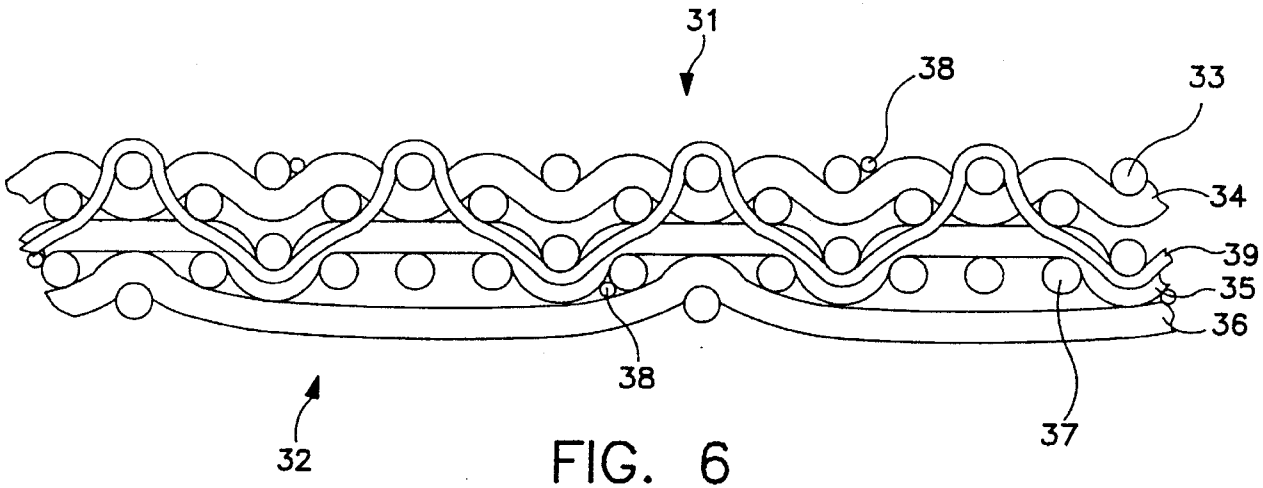
FIG. 6 is a sectional view in the warp direction of the fabric shown in FIG. 5.
Figure 7A:
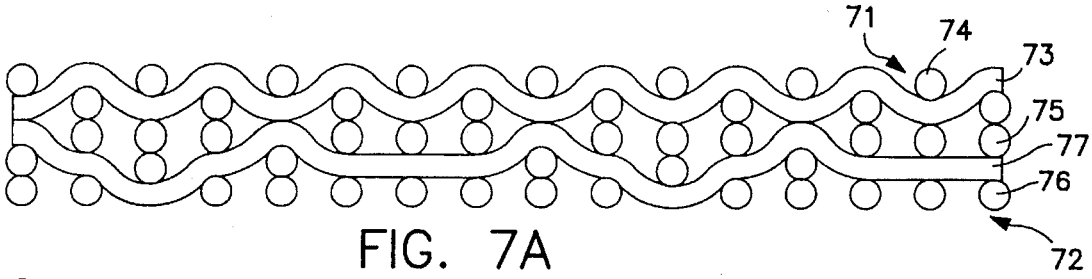
FIGS. 7A–7H, show the eight different positions of the warp direction yarns of another embodiment of the fabric of the present invention, utilizing an additional warp binder yarn.
Figure 7B:
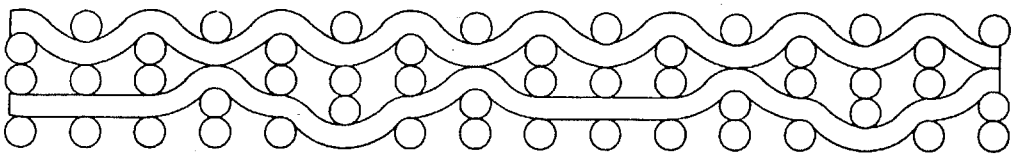
Figure 7C:
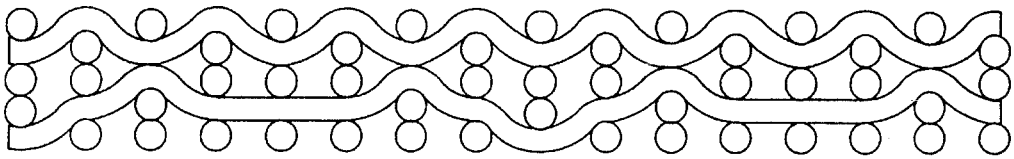
Figure 7D:
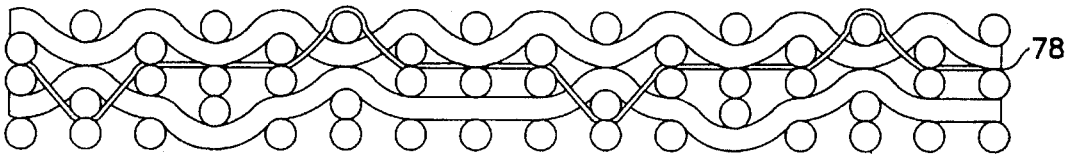
Figure 7E:
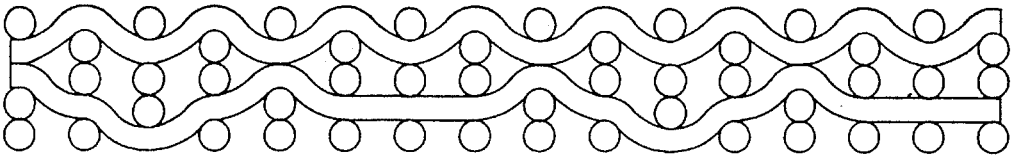
Figure 7F:
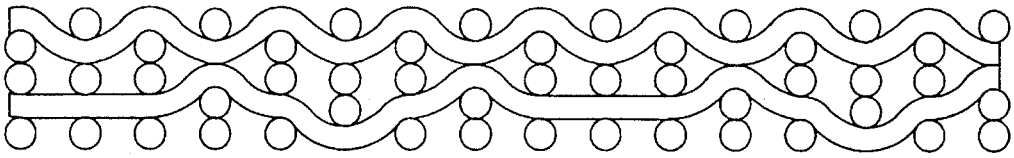
Figure 7G:
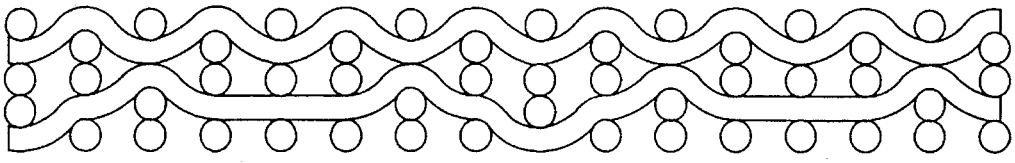
Figure 7H:
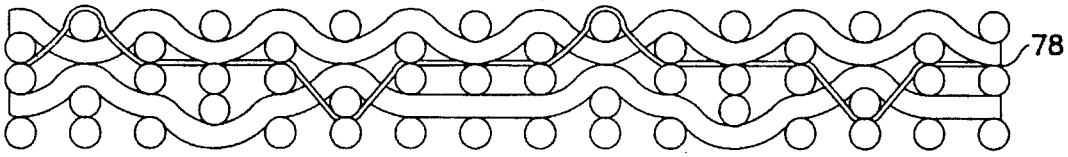

Nonetheless, warp direction binder yarns may be combined with weft direction binder yarns to achieve a fabric with an extremely rigid fabric with high resistance to delamination. FIGS. 5 and 6 illustrate this construction as a third embodiment of the fabric of the present invention. In this embodiment, additional binder yarns are present in the weft direction and in the warp direction in the weave patterns described above. Top fabric layer 31 is joined to bottom fabric layer 32 by additional binder warp yarn 38 and additional binder weft yarn 39. Top fabric layer 31 incorporates warp yarns 33 interwoven with weft yarns 34 in a plain weave pattern. In the bottom fabric layer, weft yarns 35 are generally stacked over warp yarns 36 and they are interwoven with warp yarns 37. The binder warp yarn 38 engages weft yarns 34 from the top fabric layer and weft yarns 35 from the bottom fabric layer in a predetermined pattern. Similarly, binder weft yarns engage the warp yarns 33 of the top fabric layer 31 and the warp yarns 37 of the bottom fabric layer 32. Although this construction has significant advantages in terms of rigidity and delamination, this is achieved at the cost of a reduction in the drainage index due to the large number of binder yarns.

FIG. 7 illustrates a fourth embodiment of a papermakers fabric according to the concepts of the present invention. FIGS. 7A–7H show eight different positions of the warp direction yarns 73, 77 in the fabric. As described above, the papermakers fabric includes a plain weave top layer 71, with interwoven warp direction yarns 73 and weft direction yarns 74. The bottom fabric layer 72 is a semi-duplex, 8 harness design weave. In this embodiment, however, the bottom fabric layer 72 includes weft direction yarns 75 generally stacked over weft direction yarns 76 and interwoven by warp direction yarns 77. In addition, the top fabric layer weft direction yarns are generally stacked over the weft direction yarns of the bottom fabric layer. FIGS. 7D and 7H show the positions of the binder warp yarn 78 and how it joins the top and bottom fabric layers 71, 72.

Figure 8:
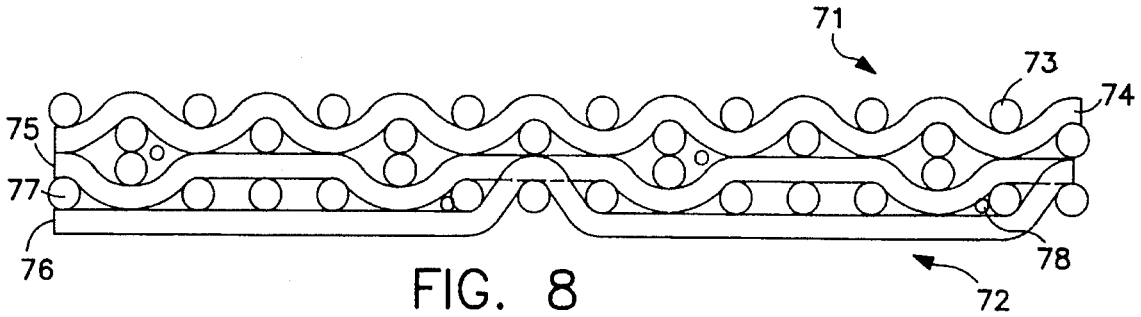
FIG. 8 is a weft direction view of the fabric of FIG. 7.

FIG. 8 illustrates the fabric of FIG. 7 in the weft direction. As can be seen, the warp direction yarns of the top fabric layer are generally stacked over the warp direction yarns of the bottom fabric layer. With the both the weft direction yarns and the machined direction yarns stacked in this manner the fabric exhibits excellent drainage characteristics. Stacking of the warp direction and weft direction yarns also produces a fabric which is highly resistant to deformation under compression forces. This is because the stacked yarns are forced against each other under compression instead of between each other in the case of an unstacked fabric. Another advantage of this configuration that the structure of the top fabric layer is not significantly influenced by the weaving of a binder warp yarn as before. Accordingly, the top surface of the fabric layer is more uniform, resulting in less marking of the paper product.

Although FIGS. 7 and 8 show a perfectly stacked fabric, it is possible to achieve the above described advantages with the structural warp and weft direction yarns less than perfectly stacked. That is, these advantages may be achieved in a fabric in which the yarns in each direction are stacked with the center axis of each yarn in less than perfectly alignment. This may be advantageous especially in light of the fact that the yarns of the top fabric layer may be relatively fine compared to the yarns of the bottom fabric layer.

Additionally, FIG. 8 clearly shows the advantage of combining a top fabric layer and semi-duplex bottom fabric layer with a binder yarn in the warp direction. As is shown, the load bearing structural warp direction yarns 77 and the additional binder yarns 78 are protected by the weft direction yarns 76 of the bottom fabric layer 72 from wear and abrasion until the weft direction yarn 76 is worn. Moreover, since the binder yarn is woven in the warp direction it is subjected to the same longitudinal stresses as the top and bottom fabric layers. The friction between the layers and the binder yarns is reduced under this construction compared to a fabric with a transverse binder yarn. As discussed above in connection with FIGS. 5 and 6, however, it is also possible to combine a transverse binder yarn with the warp binder yarn in the embodiment of FIGS. 7 and 8.

Figure 9:
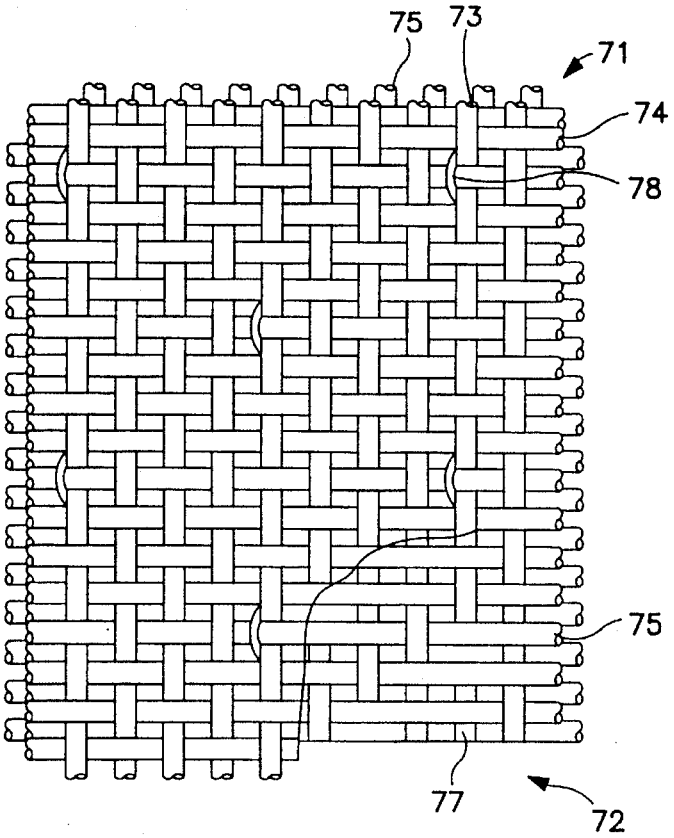
FIG. 9 illustrates the papermaking surface of the top fabric layer of the fabric of FIGS. 7 and 8 and shows the relationship between the interfacing surfaces of the two fabric layers.

FIG. 9 is a plan view of the fabric shown in FIGS. 7 and 8 showing the top papermaking surface of the papermaking fabric. The cut-out area in the right lower corner illustrates the interfacing top surface of the bottom fabric layer. The plain weave top fabric layer 71 presents an optimal papermaking surface and provides good pulp support to retain fibers from the pulp and good release of the forming paper web. The binder warp yarns 78, as discussed above, may engage the structural weft yarns in any repeating pattern. In addition, any number of binder warp yarns may be used to stitch the layers of the fabric. FIG. 9, however, represents a preferred embodiment in which a binder warp yarn is inserted adjacent every fourth structural warp yarn and stitches every eighth weft yarn of the top and bottom fabric layers.

The embodiments which have been described herein are but some of the several which utilize this invention and are set forth here by way of illustration but not of limitation. It is obvious that many other embodiments which will be readily apparent to those skilled in the art may be made without departing materially from the spirit and scope of this invention.

What is claimed is:

1. A papermakers' fabric comprising:

a top fabric layer including at least one set of warp yarns interwoven with a least one set of weft yarns;

a bottom fabric layer including at least two sets of weft yarns forming a top and bottom layer of said bottom fabric layer, said at least two sets of weft yarns being interwoven with at least one set of warp yarns; and at least one binder yarn interweaving and joining the top fabric layer and the bottom fabric layer.

2. The papermakers' fabric of claim 1 wherein the top fabric layer is a plain weave.

3. The papermakers' fabric of claim 1 wherein the bottom fabric layer is a semi-duplex weave.

4. The papermakers' fabric of claim 1 wherein said at least one binder yarn is a binder warp yarn which interweaves the top fabric layer weft yarns and the weft yarns of the top layer of said bottom fabric layer.

5. The papermakers' fabric of claim 1 wherein said at least one binder yarn is a binder weft yarn which interweaves the top fabric layer warp yarns and the bottom fabric layer warp yarns.

6. The papermakers' fabric of claim 1 wherein said at least two sets of weft yarns of said bottom fabric layer are generally stacked.

7. The papermakers' fabric of claim 1 wherein the weft yarns of said top fabric layer are generally stacked over said at least two sets of weft yarns of said bottom fabric layer.

8. The papermakers' fabric of claim 1 wherein the warp yarns of said top fabric layer are generally stacked over the warp yarns of said bottom fabric layer.

9. The papermakers' fabric of claim 1 wherein said at least one binder yarn engages every eighth weft yarn of said top fabric layer and every eighth weft yarn in said top layer of said bottom fabric layer.

10. The papermakers' fabric of claim 1 wherein said at least one binder yarn engages every fourth warp yarn of said top fabric layer and every fourth warp yarn in said bottom fabric layer.

11. A papermakers' fabric comprising:

a top fabric layer including at least one set of warp yarns interwoven with a least one set of weft yarns;

a bottom fabric layer including at least two sets of weft yarns forming a top and bottom layer of said bottom fabric layer, said at least two sets of weft yarns being interwoven with at least one set of warp yarns;

at least one binder warp yarn interweaving and joining the top fabric layer weft yarns and the weft yarns of the top layer of the bottom fabric layer; and at least one binder weft yarn interweaving and joining the top fabric layer warp yarns and the bottom fabric layer warp yarns.

12. The papermakers' fabric of claim 11 wherein the top fabric layer is a plain weave.

13. The papermakers' fabric of claim 11 wherein the bottom fabric layer is a semi-duplex weave.

14. The papermakers' fabric of claim 11 wherein said at least two sets of weft yarns of said bottom fabric layer are generally stacked.

15. The papermakers' fabric of claim 11 wherein the weft yarns of said top fabric layer are generally stacked over said at least two sets of weft yarns of said bottom fabric layer.

16. The papermakers' fabric of claim 11 wherein the warp yarns of said top fabric layer are generally stacked over the warp yarns of said bottom fabric layer.

17. The papermakers' fabric of claim 11 wherein said at least one binder warp yarn engages every eighth weft yarn of said top fabric layer and every eighth weft yarn in said top layer of said bottom fabric layer.

18. The papermakers' fabric of claim 11 wherein said at least one binder weft yarn engages every fourth warp yarn of said top fabric layer and every fourth warp yarn of said bottom fabric layer.

* * * * *